United States Patent [19]

Kinoshita et al.

[11] Patent Number: 4,825,617

[45] Date of Patent: May 2, 1989

[54] FIRE-RESISTANT OPEN JOINT STRUCTURE AND ITS METHOD

[75] Inventors: Ryoji Kinoshita, Koube; Keizou Misawa, Nishinomiya; Hideaki Watanabe, Kobe; Hidehiko Aoki, Toshima; Toshio Kurokawa, Furukawa; Hidefumi Ono, Sarushima, all of Japan

[73] Assignees: Kawatetsu Kenzai Kogyo Co., Ltd., Hyogo; Miyoshi Shokai Co., Ltd., Kanagawa, both of Japan

[21] Appl. No.: 34,290

[22] PCT Filed: Jul. 3, 1986

[86] PCT No.: PCT/JP86/00343

§ 371 Date: Mar. 5, 1987

§ 102(e) Date: Mar. 5, 1987

[87] PCT Pub. No.: WO87/00225

PCT Pub. Date: Jan. 15, 1987

[30] Foreign Application Priority Data

Jul. 5, 1985 [JP] Japan ..... 60-148943

[51] Int. Cl.[4] ..... E04B 1/68; E04B 1/70

[52] U.S. Cl. ..... 52/573; 52/235; 52/305; 52/396; 52/403

[58] Field of Search ..... 52/402, 396, 605, 573, 52/403, 302, 303, 305, 235, 586; 14/73, 74; 404/37, 47, 67, 68

[56] References Cited

U.S. PATENT DOCUMENTS

| | | | |
|---|---|---|---|
| 1,958,391 | 5/1934 | Hall et al. | 404/47 |
| 2,161,333 | 6/1939 | Capouch | 404/67 |
| 2,266,464 | 12/1941 | Kraft | 52/396 |
| 2,976,782 | 3/1961 | Thom | 404/47 |
| 3,363,383 | 1/1968 | La Barge | 52/573 |
| 3,526,071 | 9/1970 | Watanabe | 52/396 |
| 3,572,224 | 3/1971 | Perry | 52/586 |
| 4,525,963 | 7/1985 | Gartner | 52/235 |
| 4,543,756 | 10/1985 | Kaminaga et al. | 52/235 |
| 4,561,225 | 12/1985 | Gartner | 52/235 |
| 4,571,905 | 2/1986 | Kaminaga | 52/235 |
| 4,596,099 | 6/1986 | Kaminaga | 52/235 |
| 4,599,838 | 7/1986 | Kaminaga | 52/235 |
| 4,614,067 | 9/1986 | Matsubara | 52/235 |
| 4,619,092 | 10/1986 | Kaminaga | 52/235 |

FOREIGN PATENT DOCUMENTS

| | | | |
|---|---|---|---|
| 57-89606 | 6/1982 | Japan . | |
| 504570 | 4/1939 | United Kingdom | 404/67 |

*Primary Examiner*—Michael Safavi

*Attorney, Agent, or Firm*—Birch, Stewart, Kolasch & Birch

[57] ABSTRACT

In an open joint structure for the prevention of water leakage an isobaric space is formed which has no difference between pressure in the space and ambient pressure. The open joint structure contains at least one groove 11 extending in the vertical direction formed on the exterior side of a vertical edge of a precast concrete curtain wall and which faces an opposing groove 11 of an adjacent precast concrete curtain wall. A heat barrier plate 10 with cutout portions on through holes 13 is mounted between the side walls in the grooves, thereby dividing the isobaric space into a fire-blocking isobaric space (A) between the exterior side of the wall and the heat barrier plate 10 and a radiant heat-blocking isobaric space (B) between the heat barrier plate 10 and a pair of preformed sealants 20, 20. This structure exhibits both a fire-resistant function and a watertight function in an open construction method.

4 Claims, 6 Drawing Sheets

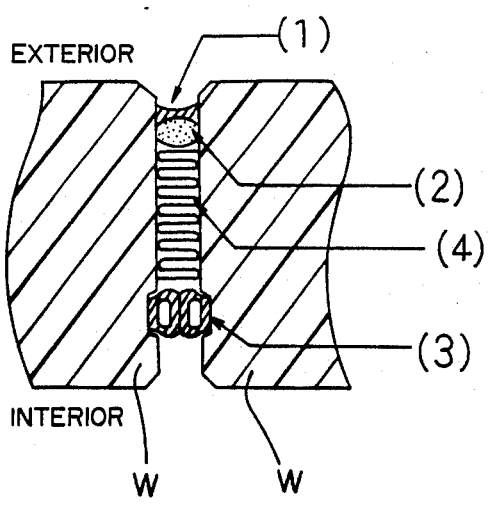
FIG. 11 'PRIOR ART'
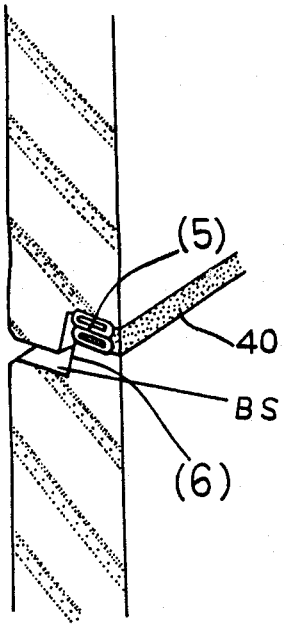
FIG. 13 'PRIOR ART'
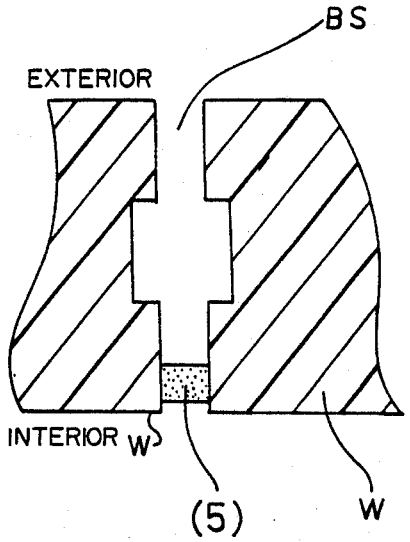
FIG. 12 'PRIOR ART'

FIRE-RESISTANT OPEN JOINT STRUCTURE AND ITS METHOD

FIELD OF THE INVENTION

The present invention relates to improvements in the open joint method for a precast concrete curtain wall and, more particularly, to the fire-resistant open joint structure and its method for joining. In particular, a vertical joint is adapted to make the precast concrete curtain wall thinner, that is, such a joint, particularly a vertical joint, is formed between panels, a panel and a sash or a panel and a structural frame.

DESCRIPTION OF THE BACKGROUND ART

In recent years, a so-called open joint method has been adopted as a watertight method for precast concrete curtain walls. This open joint method is capable of smoothly discharging rainwater driven in through a joint by having an opening with a gap of an appropriate width in the joint so as to have an isobaric space therein. This isobaric space has no pressure differential from the outside. Heretofore, as shown in FIG. 11, a method has been adopted which uses a double seal method that is constructed so as to prevent water from penetrating into the joint by filling up the front portion of a joint S with a gun grade sealant (1) on to a backing material (2) and mounting a preformed elastic sealant (3) at the back of the joint to form a watertight layer. However, if the life of the sealant is relatively shorter than that of the precast concrete curtain wall or the like and defects occur in the seal (for instance, interlaminar deviations or other problems), water driven in through the joint may created a pressure differential within the joint and thereby cause water leakage.

As shown in FIG. 12, the open joint method exhibits a watertight effect by an isobaric space BS. The isobaric space, however, is open to the exterior so that it may become a passage through which fire flames could enter. In this case, only a wind barrier (5) mounted at the back of the joint is not satisfactory for fire-resistant performance so that the exterior walls need to be thick enough for fire resistance. In particular, the vertical joint is not provided with a flashing (6) as is used in a horizontal joint, as shown in FIG. 13. Thus, the improvements for the vertical joint in fire-resistant performance are restricted. Of course, as shown in FIG. 11, such fire-resistant performance can be provided on the vertical joint if a fire-resistant material (4) would be filled in the joint. It is to be understood, however, that this loses the meaning of the open joint method which utilizes the isobaric space.

OBJECT OF INVENTION

The present invention has an object of providing a fire-resistant open joint structure and its construction method designed to provide fire-resistant performance while maintaining a watertight effect achieved by the open joint method without becoming an obstacle to the construction of the open joint method, in view of the current situation in which the open joint method is being adopted in the construction of precast concrete curtain walls and the like. Such an open joint structure will create the starting point for making a thinner wall plate.

As a result of extensive studies on open joint systems with the goal of obtaining both fire-resistant properties and watertight properties, the present invention was completed on the basis that a fire could be blocked completely without hindering the functions originated from the isobaric space in the open joint method by dividing an isobaric space formed outside a wind barrier in a vertical joint by mounting a heat barrier plate with through-holes in the joint into front and rear spaces. The first isobaric space is designed so as to be capable of blocking a fire between the exterior side of the exterior wall and the heat barrier plate, on the one hand, and the second isobaric space is designed so as to be capable of blocking radiant heat from the heat barrier plate between the heat barrier plate and the wind barrier by way of convection caused in the air layer. Thus, rainwater penetrating through the joint from outside the exterior wall is blocked by the first and second isobaric spaces and the heat barrier plate dividing the two spaces. Fire is furthermore blocked by the fire-blocking action of the heat barrier plate and the air convection action in the second isobaric space.

The fire-resistant open joint structure according to the present invention is characterized, as shown in FIG. 1(*d*), in that, in the open joint structure capable of preventing water from penetrating into the precast concrete curtain wall joint by forming an isobaric space with no pressure differential from the outside, the vertical edge of one precast concrete curtain wall (panel W) is provided with at least one groove 11 in the vertical direction. This groove 11 on the exterior side of the joint faces an opposing groove 11 formed likewise on the adjacent panel. A heat barrier plate 10 with cutout portions 13 on the side portions thereof is mounted so as to bridge the side walls of the grooves and a pair of preformed sealants 20 and 20 are mounted on the facing vertical edges of the walls at the back of the joint between the panels W, thereby forming an isobaric space for blocking a fire between the exterior side of the curtain wall panel and the heat barrier plate 10 as well as for forming an isobaric space for the blocking of the radiant heat between heat barrier plate 10 and a pair of the preformed sealants 20 and 20.

It is preferred to use as the heat barrier plate 10 a continuous metal plate having a flange portion 12 formed by bending both sides of the plate. The flange portion is provided with cutout portion 13 as shown in FIG. 2. However, while cutout portions 13 are indicated in FIG. 2, it is contemplated that through-holes may also be used in the flange portions 12.

It is also preferred that the preformed sealant 20 be a sponge gasket in the form of a hollow rod and having a fire-resistant property.

The fire-resistant open joint structure according to the present invention is further characterized, as shown in FIGS. 1(*a*) to 1(*d*), inclusive, in that the open joint method is carried out by mounting the preformed sealant at the back of the vertical edge of the precast concrete curtain walls, panels W, W, and by constructing the precast concrete wall panels W, W with the positioning grooves 11 formed on the exterior sides of the vertical edges so as to extend in the vertical direction and to face each other on the exterior side of the joint and so as to abut the preformed sealant 20 of the precast concrete wall W with a preformed sealant 20 mounted on the adjacent precast concrete wall W to form a second seal. The heat barrier plate 10 having cutout portions or through-holes 13 between the positioning grooves 11 and 11 arranged facing each other in the vertical joint between the precast concrete wall panels, thereby forming a fire-blocking isobaric space (A) between the outside of the panels and the first seal 10 and a radiant heat-blocking isobaric space (B) between the first seal 10 and the second seal 20.

A plurality of heat barrier plates 10 may be mounted in the positioning grooves 11 in the front-to-rear order as the first seal 10 (FIG. 3).

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein:

FIG. 11 is a diagrammatical sectional view illustrating a conventional fire-resistant open joint structure;

FIG. 12 is a cross sectional view illustrating a vertical joint structure formed by the conventional open joint method; and FIG. 13 is a perspective view illustrating a horizontal joint structure formed by the conventional open joint method.

DETAILED DESCRIPTION OF THE PREFERRED EMBODIMENTS

The fire-resistant open joint structure according to the present invention may be constructed by the following procedures.

As shown in FIG. 1(*a*), a curtain wall panel W is formed with a preformed sealant 20 mounted at the back of on vertical edge. This preformed sealant 20 acts as a wind barrier. A positioning groove 11 extending in the vertical direction of the edge is formed on the exterior side of the joint. Exterior curtain wall panels such as precast concrete panels (hereinafter referred to as "PC panels") W and W are constructed by a conventional open joint method. For instance, as shown in FIG. 1(*b*), a PC panel W is pulled between the PC panels placed on both sides thereof and set near the position where it is installed. With a fastener mounted, the level and the surface are adjusted and then a secondary fastener on the PC panel side is connected to a primary fastener on the side of the structural frame with bolts and nuts.

Figure 5:
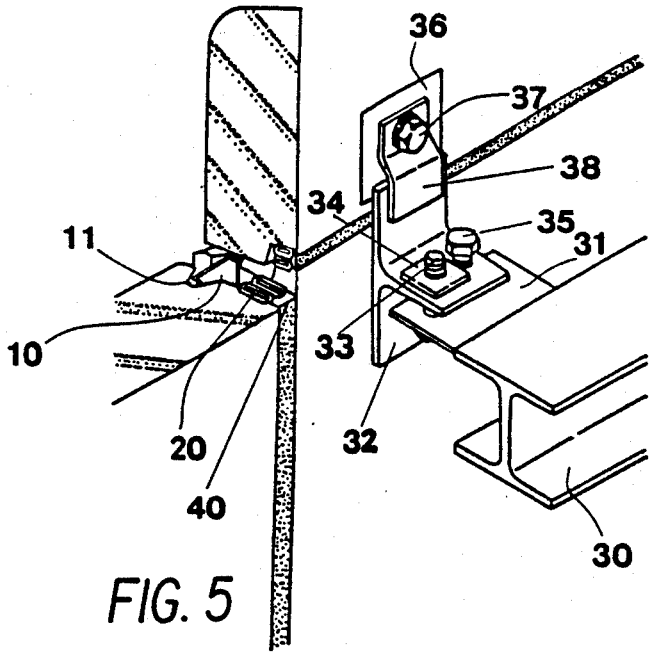
FIG. 5 is a partially sectional, perspective view illustrating the detail of installation of the vertical joint structure.
Figure 6A:
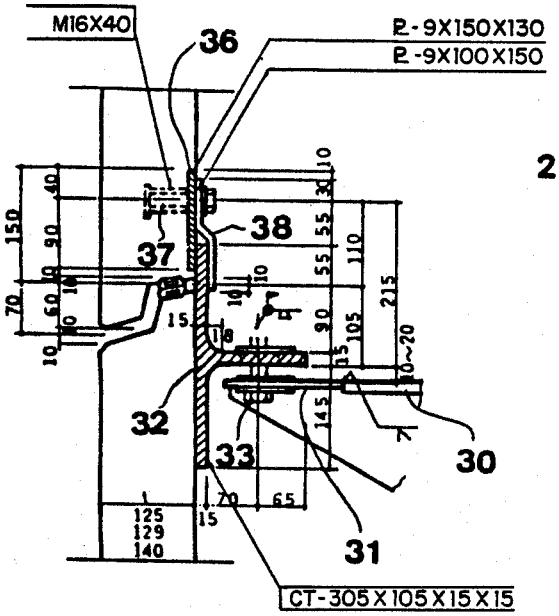
FIGS. 6(*a*) and 6(*b*), respectively, are a side elevation and a plan view representing the installation details indicating the actual dimensions.
Figure 6B:
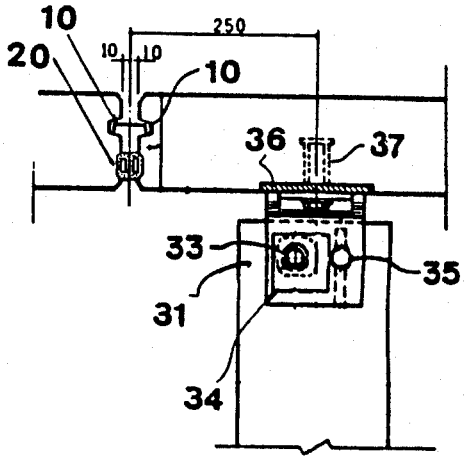

More specifically, as shown in FIGS. 5, 6(*a*) and 6(*b*), a T-shaped anchor plate 32 embedded in and fixed to the upper portion of the lower wall panel W is installed to a support plate 31 extending from a beam 30 of the H-section with an adjustable bolt 33 and a washer 34 with an eccentric hole. The level adjustment is conducted with a level adjusting bolt 35. On the other hand, an anchor plate 36 embedded at the lower portion of the upper wall panel W is connected to a Z-shaped steel plate 38 through an insert 37 so as to cause the Z-shaped steel plate 38 to come in mesh with the projection of the embedded T-shaped anchor plate 32. This allows the Z-shaped steel plate 38 to install the wall panel W in a manner to permit swaying in the horizontal directions with small swinging motions caused by middle-size earthquakes and the adjustable bolt 33 is installed in a manner to be locked against large shocks caused by big earthquakes.

Turning now to FIG. 1(*c*), the preformed sealants 20 and 20 are securedly abutted with each other at the back of the vertical joint to form the secondary seal as a wind barier, and the positioning grooves 11 and 11 of the wall panels are adjacent to each other and extend in the vertical direction at the front of the joint.

Figure 2:
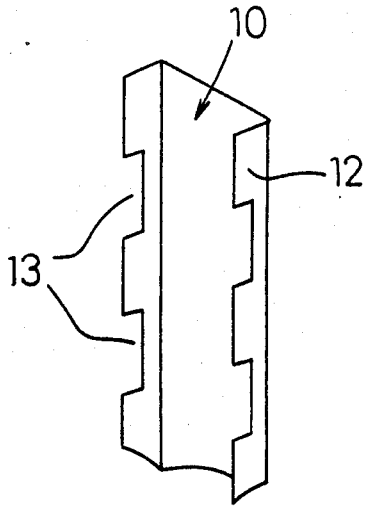
FIG. 2 is a perspective view illustrating a heat barrier plate preferable in performing the fire-resistant open joint method according to the present invention.

The isobaric space BS formed on the exterior side of the joint in front of the second seal is then divided into front and rear spaces by inserting the first seal from the top so as to bridge between the positioning grooves 11 and 11 which face each other. As shown in FIG. 2, the first seal is constituted by a heat barrier plate, for example, a heat barrier plate 10 of a continuous thin stainless steel with flange portions 12 formed by folding both sides thereof and forming cutout portions 13. While FIG. 2 shows only cutout portions, it is contemplated that through-holes may also be formed in flange portions 12. As shown in FIG. 1(*d*), the isobaric space BS is provided with the first isobaric space (A) for blocking fire between the exterior side of the wall panel and the first seal and the second isobaric space (B) for blocking radiant heat between the first seal and the second seal.

Figure 3:
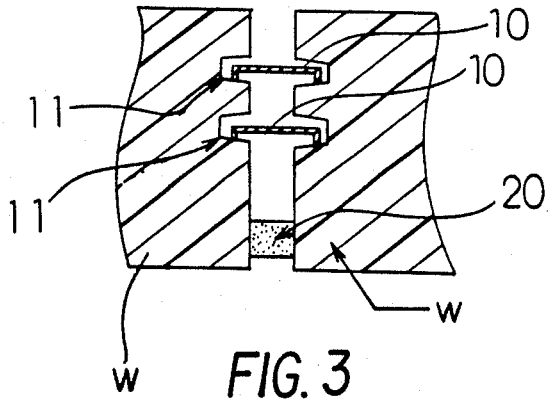
FIG. 3 is a cross sectional view illustrating a variation of the vertical joint structure shown in FIG. 1(*d*)

Referring now to FIG. 3, the heat barrier plate 10 as the first seal may be mounted each in pairs of the positioning grooves 11 and 11 formed in a line on the edges of the adjacent PC wall panels. A spaced formed by the positioning grooves 11, 11 and the heat barrier plate 10 should be ensured as an isobaric space in order to avoid a reduction in the pressure therein. A gap formed by the heat barrier plate 10 and the positioning grooves 11, 11 should also be ensured to not be closed by movement of the heat barrier plate 10 mounted in the grooves 11, 11 or by rainwater entering into the grooves 11, 11.

Figure 1A:
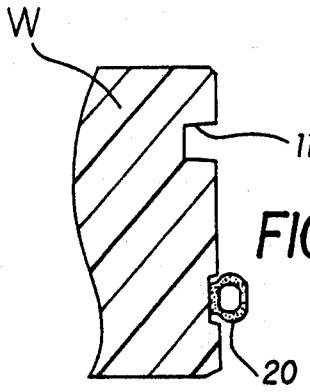
FIGS. 1(*a*) to 1(*d*), inclusive, are each a diagrammatical view illustrating the steps of the construction of the fire-resistant open joint method according to the present invention.
Figure 1B:
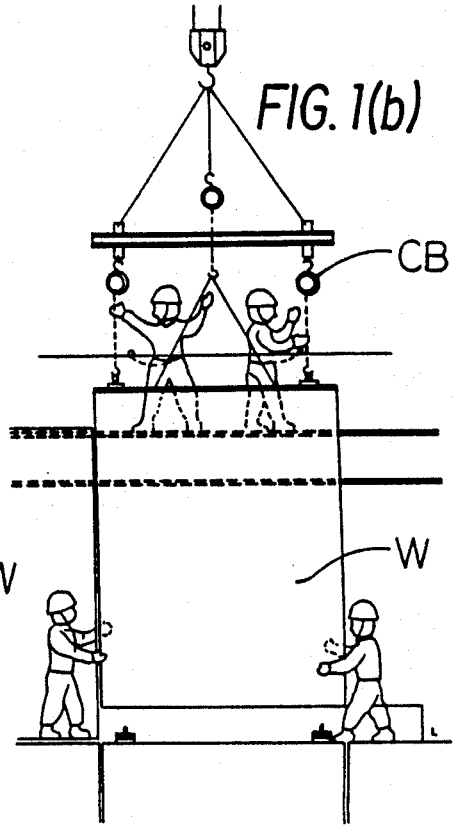
Figure 1C:
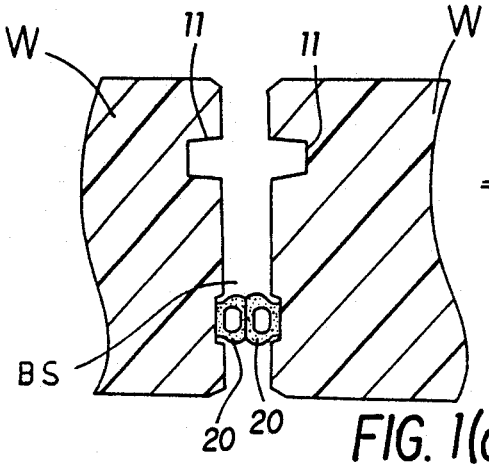
Figure 4:
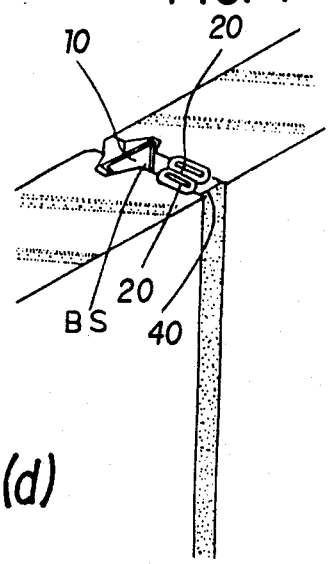
FIG. 4 is a partially sectional, perspective view illustrating the vertical joint structure of the open joint structure according to the present invention.
Figure 1D:
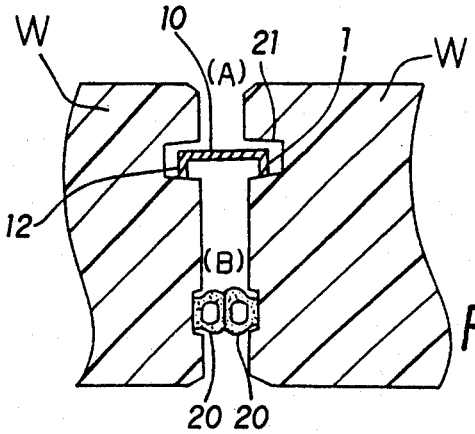

It is preferred to finish the inside of the wind barrier 20 by mounting a non-combustible joint material 40 as shown in FIG. 4.

Figure 7:
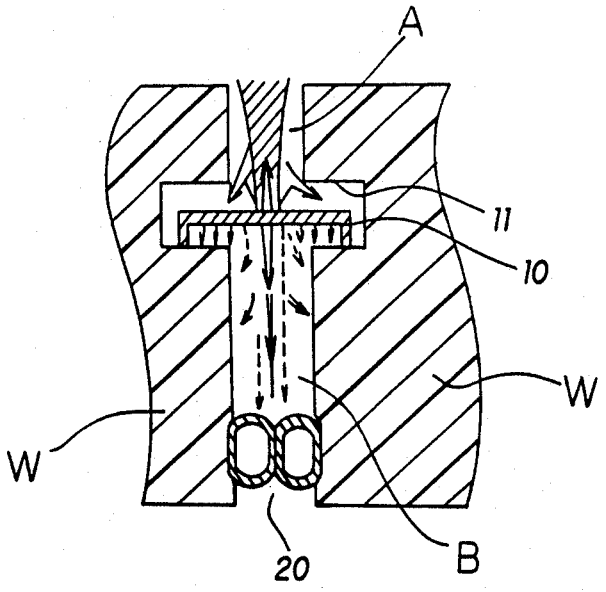
FIG. 7 is a diagrammatical view describing the fire-resistant action.
Figure 8:
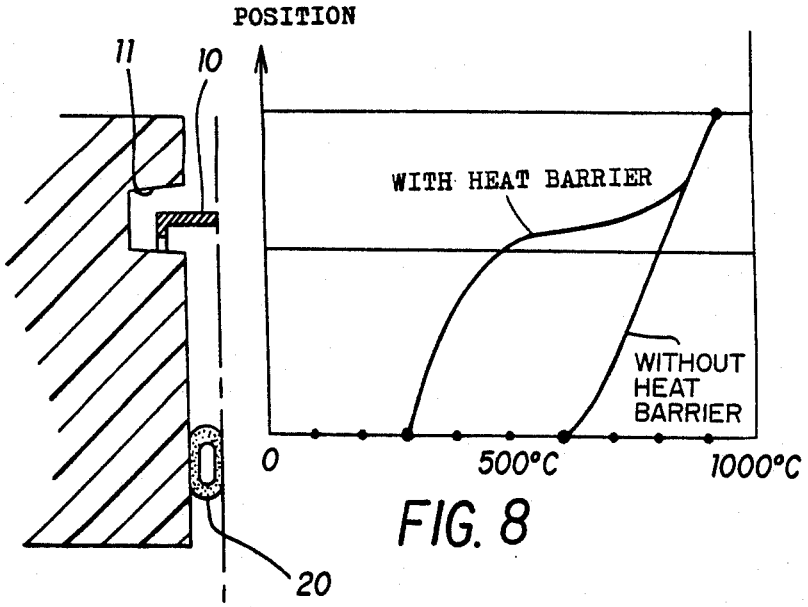
FIG. 8 is a graph comparing the fire-resistant effect attained by the joint constructed by the fire-resistant and watertight open joint method according to the present invention with that attained by a joint without any fire-resistant and watertight treatment.

In the fire-resistant and watertight joint structure constructed by the open joint method as described above, fire coming from outside the exterior concrete wall panel W can be blocked by the heat barrier plate 10 from entering into the second isobaric space (B) on the rear portion of the joint, as shown in FIG. 7. Furthermore, although radiant heat extends from the heat barrier plate 10 to the second isobaric space (B) between it and the second seal 20, the radiant heat is absorbed by an air layer in the space and discharged to the outside by means of a convection phenomenon, thereby exhibiting an action of heat discharge. Such fire-resistant effects were confirmed by the following tests. That is, a phenomenon of a decrease in temperatures of fire outside PC panels was followed where a heat barrier plate 10 is mounted in the front positioning groove 11 of the thin PC panel and where no heat barrier plate is mounted therein. The results are shown in FIG. 8. It will be found from the results that the temperatures near the preformed sealant 20 reached about 600° C. in instances where no heat barrier plate is inserted, while the temperatures near the preformed sealant 20 dropped to about 300° C. or lower in instances where the heat barrier plate 20 is inserted.

It is noted that, in the structure as described above, rainwater enters into the first isobaric space (A) as it hits on the exterior side of the curtain wall, but it hits on the heat barrier plate 10, thereby falling along the surface of the heat barrier plate 10.

The rainwater hit on the heat barrier plate 10 which is likely to enter into the rear space through gaps between the heat barrier plate 10 and the positioning groove 11 (as splashes or the like) is caused to drop down the wall portion of the positioning groove 11 without any suction force occurring because the second isobaric space (B) is formed of a relative length so as not to create any difference in the atmospheric pressure from the first isobaric space (A) by way of the cutout portions or through-holes 13 formed on the flange portions 12 of the heat barrier plate 10. For instance, even if rainwater could enter into the second isobaric space (B), it will not reach the preformed sealants 20 and 20 constituting a rear wind barrier.

The watertight effect was tested by the following procedures.

Figure 9A:
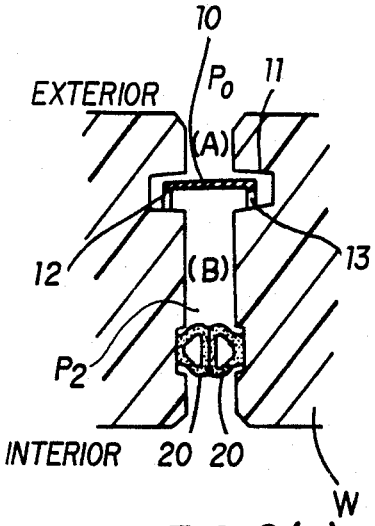
FIGS. 9(*a*) and 9(*b*), respectively, are cross sectional views illustrating the fire-resistant open joint structure according to the present invention and an open joint structure used for comparison purposes.
Figure 9B:
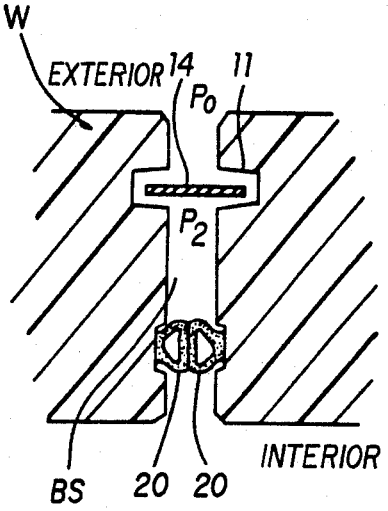

As equipment for testing the watertightness of the vertical joint structure of PC panels formed in accordance with the present invention, there were made a plate having flange portions with cutout portions, as shown in FIG. 9(*a*), and a plain plate without any flange portion having cutout portions, as shown in FIG. 9(*b*). Tests for the watertight effects were then determined in the following manner.

Figure 10:
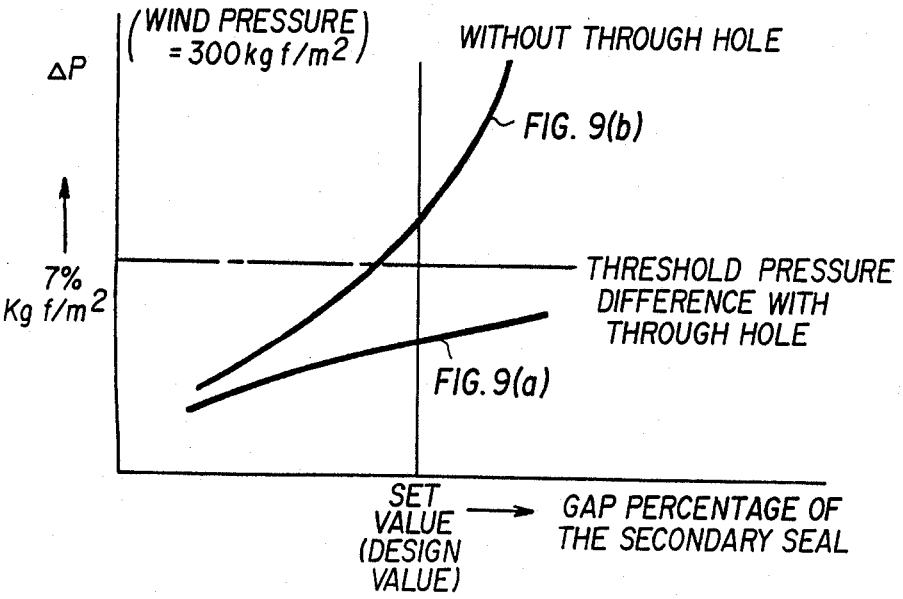
FIG. 10 is a graph showing watertightness performance.

As shown in FIG. 10, the embodiment shown in FIG. 9(*a* ) does not greatly increase the pressure difference $\Delta P$ between the ambient pressure Po and the pressure Pz in the second isobaric space (B) formed between the first seal 10 and the second seals 20 as a gap percentage between the second seals 20, 20 increases. And the pressure differential does not exceed a threshold pressure differential for a limit on water leakage (usually 7 to 10 kg f/m$^2$ at the maximum wind pressure of 300 kg f/m$^2$) in a range in which the PC panel swings even if the gap percentage would vary to a great extent, thus preventing water leakage from the second seals. On the contrary, the embodiment shown in FIG. 9(*b*) does vary to a great extent with an increase in pressure differentials P between the ambient pressure Po and the pressure Pz in the second isobaric space (BS) formed between the first seal 14 and the second seals 20 as the gap percentage changes and the pressure differential in a range of values in which gap percentages should be set exceeds the threshold pressure differential, whereby water leakage may occur from the second seals 20.

Therefore, the embodiment of FIG. 9(*a*) having the heat barrier plate with flange portions with cutout or through-holes used to divide the space into the first isobaric space A and the second isobaric space B has more water leakage prevention ability than the embodiment shown in FIG. 9(*b*) with a baffle 14 employed. When using the embodiment of FIG. 9(*a*), the thickness of the precast concrete panel can be made thinner.

As will be apparent from the above description, the present invention provides a first isobaric space (A) between the exterior side of the curtain wall panel and the first seal, which can block fire by the heat barrier plate of a continuous length, and the second isobaric space (B) between the first and second seals, which can block radiant heat from the first seal by the convection of an air layer. This construction leads to the complete blocking of rainwater driven in through the joint from the exterior side of the curtain wall panel by the first and second isobaric spaces and the heat barrier plate partitioning the spaces for having the fire blocking effect of the heat barrier plate and the convection action of the air layer in the second isobaric space. As conventional joint methods have the shortcoming of providing a rather poor fire resistant design, the present invention overcomes such obstacles of prior art methods and provides a joint structure having a predetermined degree of fire resistance while enabling a thinner curtain wall to be used. Moreover, the present invention exhibits desired fire-resistant and watertight effects without difficulty even if the walls are rendered thinner, so that it becomes the starting point of making an exterior precast concrete curtain wall a thinner plate. It is also to be noted that, since the heat barrier plate used for the present invention becomes a substitute for a fireproof insulating material used in conventional methods, the present invention does not demonstrate drawbacks of a decrease in fire-resistant performance due to leakage from the fireproof insulating material caused by sealing defects arising from an interlaminar displacement or the like, as in conventional methods. It is further to be noted that the construction work for the open joint method according to the present invention is rendered very simple because the heat barrier plate can be inserted after the build-up of curtain walls.

Although the present invention has been described by making references to the vertical joint structure of PC curtain walls as an embodiment, it is needless to state that it can be applied likewise to metal curtain walls and GRC curtain walls. Furthermore, like construction can, of course, be applied to horizontal joints.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A fire resistant open joint structure for a wall made from a plurality of wall sections, each of said wall sections having vertical edges along at least two sides thereof, a first one of said vertical edges of one wall section being placed proximate to a second vertical edge of another wall section to form said wall, each of said wall sections having an exterior side and an interior side, said open joint structure comprising:

at least one vertical groove formed in said first vertical edge;

at least one vertical groove formed in said second vertical edge, said groove of said first edge facing said groove of said second edge when said wall sections are placed proximate one another;

a preformed sealant positioned on an interior side of each of said vertical edges of said wall sections, sealant on said first vertical edge abutting sealant on said second vertical edge when said wall sections are placed proximate one another;

a heat barrier plate extending between said groove of said first vertical edge and said groove of said second vertical edge to form two isobaric spaces, said first isobaric space being disposed on one side of said plate and extending to the exterior side of said wall sections, said second isobaric space being disposed on the other side of said plate and extending in a direction toward the interior side of said wall sections to abutting sealants, said first isobaric space forming a fire-blocking isobaric space whereby a fire on the exterior side of said wall can be blocked by said heat barrier plate, said second isobaric space forming a radiant heat-blocking isobaric space whereby radiant heat from said first isobaric space can be discharged, said first and second isobaric spaces therefore aiding in fire-resistance, said heat barrier plate having two vertically extending edges which are folded for giving said plate a generally U-shaped cross section, said plate being of a continuous length along said vertical grooves; and communication means on said heat barrier plate for permitting said first isobaric space to be in communication with said second isobaric space, said communication means further preventing rainwater from leaking through said joint structure thus forming a watertight joint structure, said communication means comprises cutout portions located along the folded edges of said heat barrier plate, said cutout portions aiding in preventing suction from being created when rainwater enters the joint structure and runs downwardly thereby maintaining said joint structure watertight.

2. The fire-resistant open joint structure as recited in claim 1, wherein said sealants on the interior sides of each of said vertical edges are a sponge gasket formed in a hollow rod shape.

3. A fire resistant open joint structure for a wall made from a plurality of wall sections, each of said wall sections having vertical edges along at least two sides thereof, a first one of said vertical edges of one wall section being placed proximate to a second vertical edge of another wall section to form said wall, each of said wall sections having an exterior side and an interior side, said open joint structure comprising:

at least one vertical groove formed in said first vertical edge;

at least one vertical groove formed in said second vertical edge, said groove of said first edge facing said groove of said second edge when said wall sections are placed proximate one another;

a preformed sealant positioned on an interior side of each of said vertical edges of said wall sections, sealant on said first vertical edge abutting sealant on said second vertical edge when said wall sections are placed proximate one another;

a heat barrier plate extending between said groove of said first vertical edge and said groove of said second vertical edge to form two isobaric spaces, said first isobaric space being disposed on one side of said plate and extending to the exterior side of said wall sections, said second isobaric space being disposed on the other side of said plate and extending in a direction toward the interior side of said wall sections to abutting sealants, said first isobaric space forming a fire-blocking isobaric space whereby a fire on the exterior side of said wall can be blocked by said heat barrier plate, said second isobaric space forming a radiant heat-blocking isobaric space whereby radiant heat from said first isobaric space can be discharged, said first and second isobaric spaces therefore aiding in fire-resistance, said heat barrier plate having two vertically extending edges which are folded for giving said plate a generally U-shaped cross section, said plate being of a continuous length along said vertical grooves; and communication means on said heat barrier plate for permitting said first isobaric space to be in communication with said second isobaric space, said communication means further preventing rainwater from leaking through said joint structure, thus, forming a watertight joint structure, said communication means comprises through-holes located along the folded edges of said heat barrier plate, said through-holes aiding in preventing suction from being created when rainwater enters the joint structure and runs downwardly thereby maintaining said joint structure watertight.

4. A fire resistant open joint structure for a wall made from a plurality of wall sections, each of said wall sections having vertical edges along at least two sides thereof, a first one of said vertical edges of one wall section being placed proximate to a second vertical edge of another wall section to form said wall, each of said wall sections having an exterior side and an interior side, said open joint structure comprising:

two vertical grooves formed in said first vertical edge;

two vertical grooves formed in said second vertical edge, said grooves of said first edge facing said grooves of said second edge when said wall sections are placed proximate one another;

a preformed sealant positioned on an interior side of each of said vertical edges of said wall sections, sealant on said first vertical edge abutting sealant on said second vertical edge when said wall sections are placed proximate one another;

a heat barrier plate extending between a first one of said two grooves of said first vertical edge and a first one of said two grooves of said second vertical edge to form two isobaric spaces, said first isobaric space being disposed on one side of said plate and extending to the exterior side of said wall sections, said second isobaric space being disposed on the other side of said plate and extending in a direction toward the interior side of said wall sections to abutting sealants, said first isobaric space forming a fire-blocking isobaric space whereby a fire on the exterior side of said wall can be blocked by said heat barrier plate, said second isobaric space forming a radiant heat-blocking isobaric space whereby radiant heat from said first isobaric space can be discharged, said first and second isobaric spaces therefore aiding in fire-resistance;

communication means on said heat barrier plate for permitting said first isobaric space to be in communication with said second isobaric space, said communication means further preventing rainwater from leaking through said joint structure, thus, forming a watertight joint structure; and a second heat barrier plate extending between a second one of said two vertical grooves of said first vertical edge and a second one of said two vertical grooves of said second vertical edge.

* * * * *